United States Patent [19]

Walter et al.

[11] 4,401,354

[45] Aug. 30, 1983

[54] LOW COST BUS STRIP

[75] Inventors: Leo Walter, Palos Verdes Estates; Helmut W. Greul, Rolling Hills Estates, both of Calif.

[73] Assignee: Buckbee-Mears Company, St. Paul, Minn.

[21] Appl. No.: 280,927

[22] Filed: Jul. 6, 1981

[51] Int. Cl.[3] ..... H01R 7/28

[52] U.S. Cl. ..... 339/19; 339/256 R; 339/278 C

[58] Field of Search ..... 339/19, 256 R, 278 C

[56] References Cited

U.S. PATENT DOCUMENTS

| | | | |
|---|---|---|---|
| 3,868,163 | 2/1975 | Jarosek | 339/19 |
| 3,951,497 | 4/1976 | Balzano | 339/19 |
| 4,033,657 | 7/1977 | Kemper | 339/19 |
| 4,150,864 | 4/1979 | Walter | 339/19 |

FOREIGN PATENT DOCUMENTS

| | | | |
|---|---|---|---|
| 2423889 | 12/1979 | France | 339/19 |

*Primary Examiner*—Joseph H. McGlynn

*Attorney, Agent, or Firm*—William W. Haefliger

[57] ABSTRACT

An electrical bus strip to receive a terminal post comprises (a) an elongated metallic bus strip;

(b) a contact integral with and spaced from said strip, said contact protruding toward a plane defined by said strip, and (c) two pairs of arms having first ends integral with said strip and second ends integral with said contact to support the contact for resiliently yieldable movement normal to said planes in response to insertion of a terminal post into position between the arms of each pair and between the contact and said strip.

Typically the bus strip defines an H-shaped opening generally in registration with said contact and arms which were stamped from said strip.

14 Claims, 13 Drawing Figures

3
25
14
10
2
14a
15
14b
21
16
21
11
11
W1
W
20
16
20
g
13b
24
P
13a
13
2
3

5
5

25
10
21
21a
25a
26
111
11b
11
11a
25b
27
20
20a 4
4
10
14b 21
11
111
16
20
13b
15

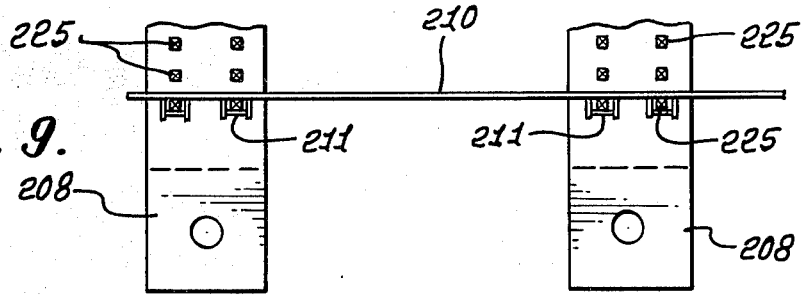
FIG. 9.
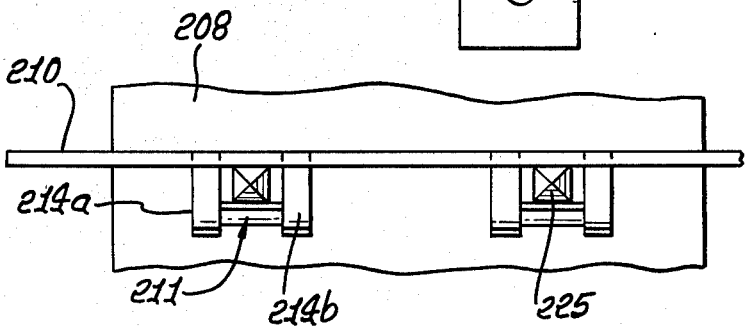
FIG. 10.
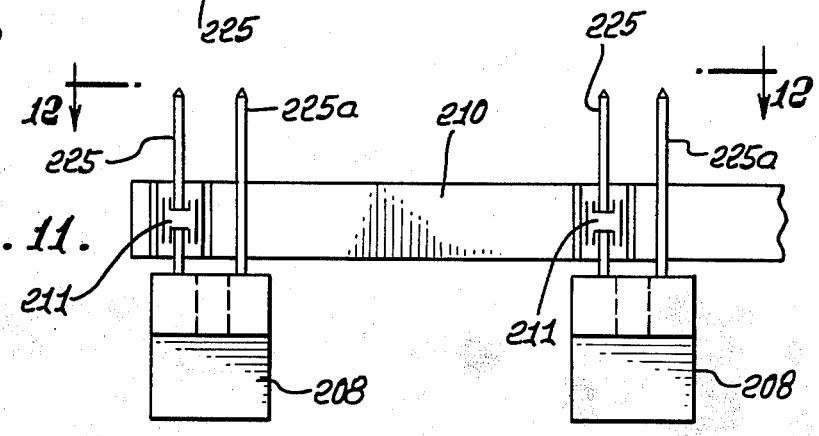
FIG. 11.
FIG. 12.
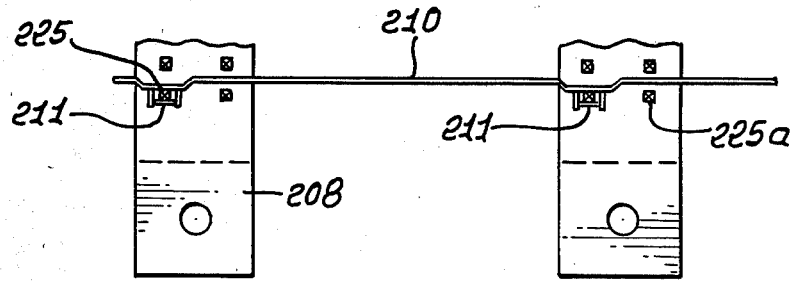
FIG. 13.
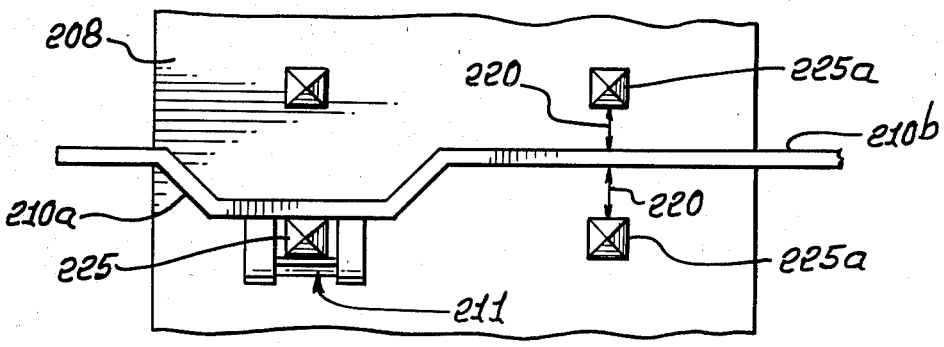

LOW COST BUS STRIP

BACKGROUND OF THE INVENTION

This invention relates generally to bus connections to terminals such as pins or posts, and more particularly concerns the provision of a bus strip having contacts and supporting arms stamped from the strip at selected spacings, which may vary in accordance with post spacings.

Prior bus connections to terminal pins or posts incorporated many disadvantages, such as lack of desired flexibility of selective connections of the post to a bus; bulkiness of the connections; need to connect contacts to the bus; need for new tooling for making different connection progressing along the strip; and lack of ease of assembly, disassembly and reassembly. U.S. Pat. No. 4,150,864 discloses a bus strip with terminal pin connections therein; however, there is need for a strip from which contacts are readily and rapidly stamped, and at selected and variable locations along the strip. U.S. Pat. No. 3,551,875 discloses a bus strip deformed to provide contacts which are not resiliently yieldable relative to the strip and so do not readily accept terminal pins that may be slightly oversize.

SUMMARY OF THE INVENTION

It is a major object of the invention to provide a low cost bus strip overcoming the above disadvantages, and having contacts and support arms which may be spaced at selected locations along the strip, the contact arms located to guide the terminal pin into resiliently yieldable engagement with the contacts; and the contacts and arms configured to be stamped from the strip, especially with miniature size. Basically, the invention is embodied in:

(a) a horizontal elongated metallic bus strip;

(b) a contact integral with and spaced from said strip, said contact protruding toward a plane defined by said strip, and (c) two pairs of arms having first ends integral with said strip and second ends integral with said contact to support the contact for resiliently yieldable movement normal to said plane in response to insertion of a terminal post into position between the arms of each pair and between the contact and said strip.

As will appear, the bus strip typically defines an H-shaped opening with branches generally in registration with the contact and its supporting arms which were stamped from the strip. Multiple of such connections may be selectively located as by selective stamping in spaced relation along a bus strip, as will be seen.

These and other objects and advantages of the invention, as well as the details of an illustrative embodiment, will be more fully understood from the following description and drawings, in which:

DRAWING DESCRIPTION

FIG. 9 is a plan view on lines 9—9 of FIG. 7;

FIG. 10 is an enlarged plan view showing details of the connections seen in FIG. 9;

FIG. 11 is another frontal elevation showing another application of the invention;

FIG. 12 is a plan view on lines 12—12 of FIG. 11; and

FIG. 13 is an enlarged plan view showing details of the connections of FIG. 12.

DETAILED DESCRIPTION

Figure 1:
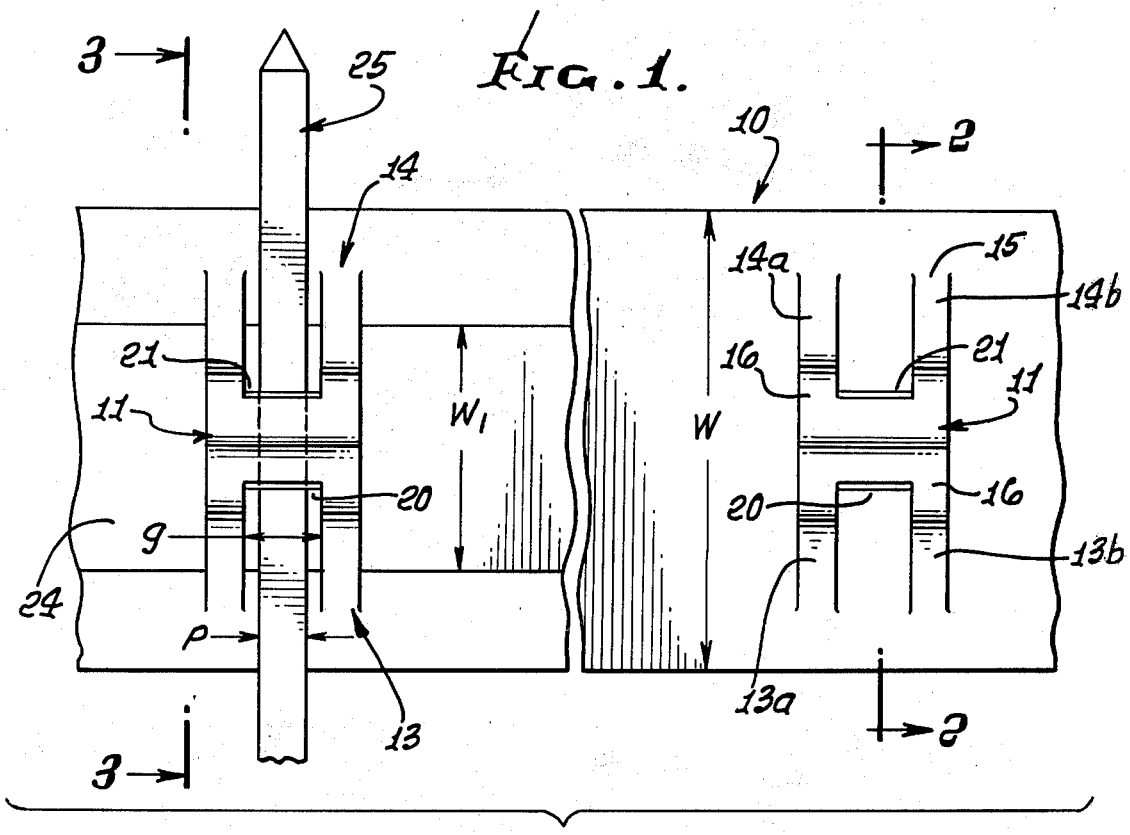
FIG. 1 is a frontal elevation.

In FIGS. 1–6, the horizontally elongated bus strip 10 has width "w" and thickness "t". These dimensions may vary, but one example is a metallic strip of width "w"between $\frac{3}{8}$ inch and $\frac{5}{8}$ inch, and thickness "t" between 0.006 and 0.010 inch. The metal may consist of beryllium, beryllium copper, copper etc., these being examples only. Generally speaking, the metal should be capable of being stamped by a die to form the contacts and arms to be described.

In accordance with the invention, a contact 11 is formed, as for example by stamping, to be integral with but spaced from the strip 10, the contact protruding toward a plane defined by the strip. In addition, two pairs 13 and 14 of arms 13*a* and 13*b* and 14*a* and 14*b* are also formed, as by the same stamping as formed the contact. The arms have first ends 15 integral with the strip, and second ends 16 integral with the contact to support the latter for resiliently yieldable movement normal to the plane of the strip, in response to insertion of a terminal post 25 into position (see FIG. 6, for example) between the arms of each pairs, and also between the contact and the bus strip. Accordingly, the post has good electrical contact with the contact and strip.

It will be noted that the bus strip defines an H-shaped opening generally in registration with the contact and arms, which were stamped from the strip. In this regard, note opening branches 113*a* and 113*b* corresponding to arms 13*a* and 13*b*; opening branches 114*a* and 114*b* corresponding to arms 14*a* and 14*b*, and opening cross-branch 111 corresponding to contact 11. Bus strip tongues 20 and 21 extend, respectively, between branches 113*a* and 113*b*, and branches 114*a* and 114*b*.

Figure 3:
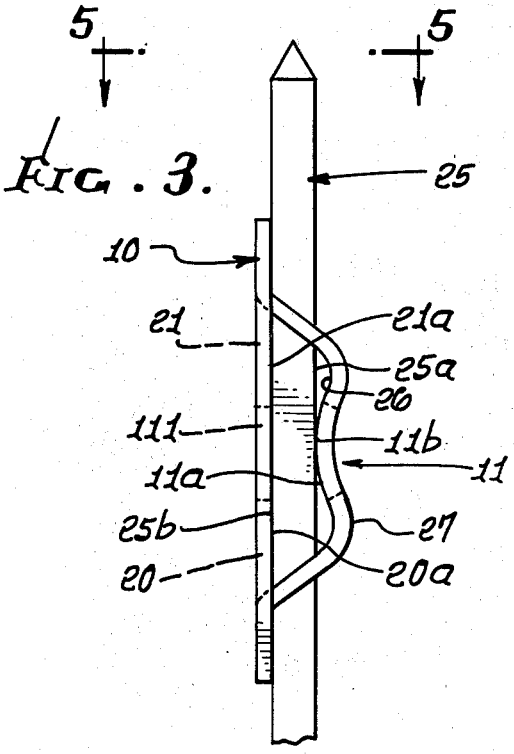
FIG. 3 is a section taken on lines 3—3 of FIG. 1.
Figure 2:
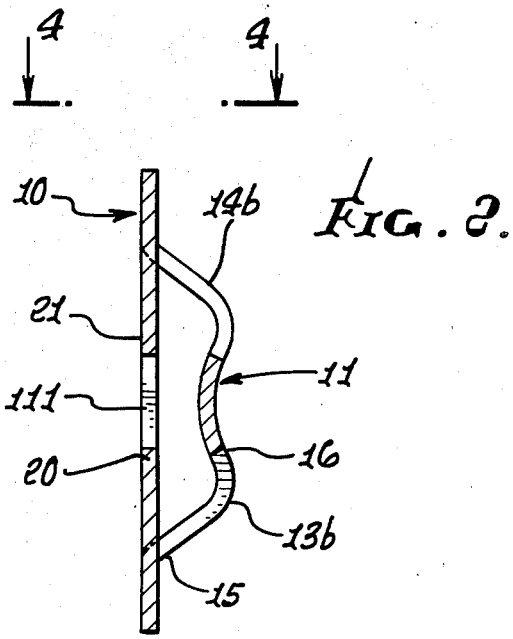
FIG. 2 is a section taken on lines 2—2 of FIG. 1.
Figure 5:
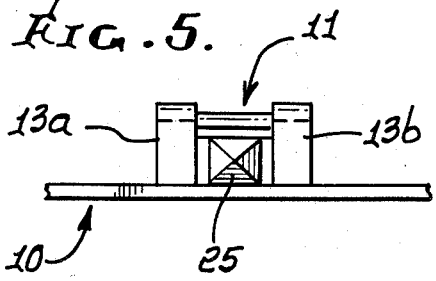
FIG. 5 is a top plan view on lines 5—5 of FIG. 3.
Figure 4:
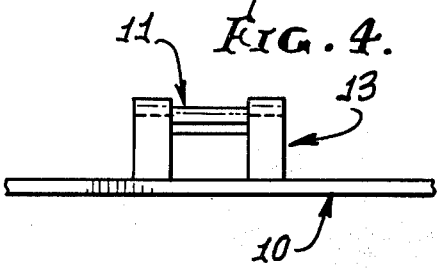
FIG. 4 is a top plan view on lines 4—4 of FIG. 2.
Figure 6:
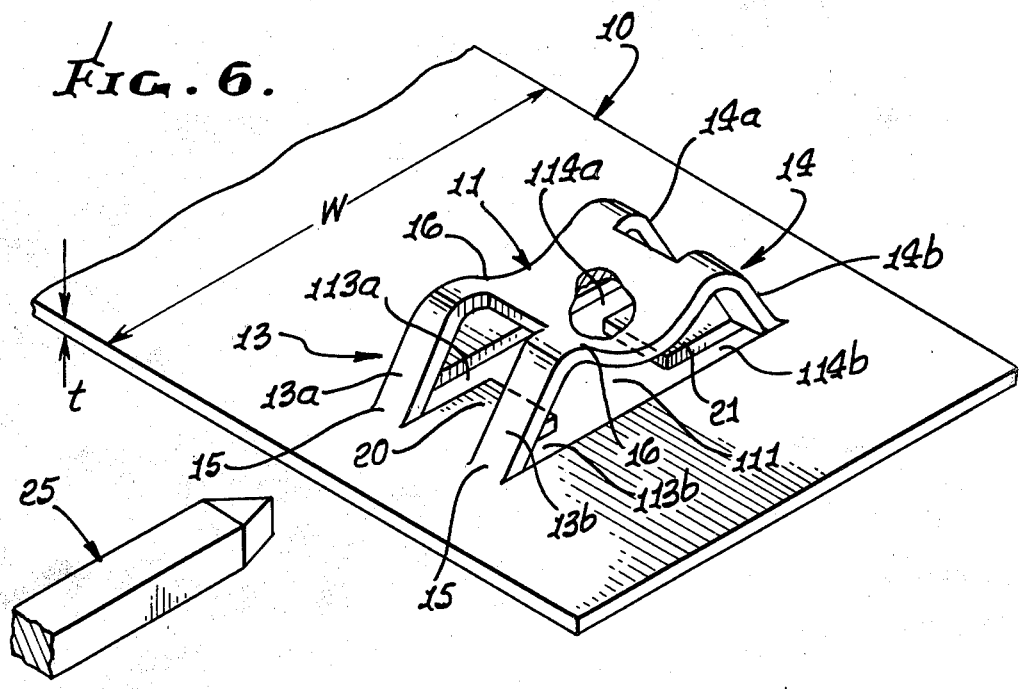
FIG. 6 is a perspective view.
Figure 8:
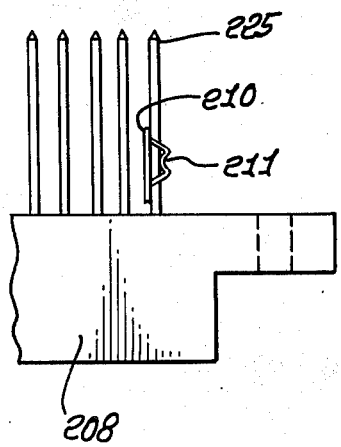
FIG. 8 is an end view on lines 8—8 of FIG. 7.
Figure 7:
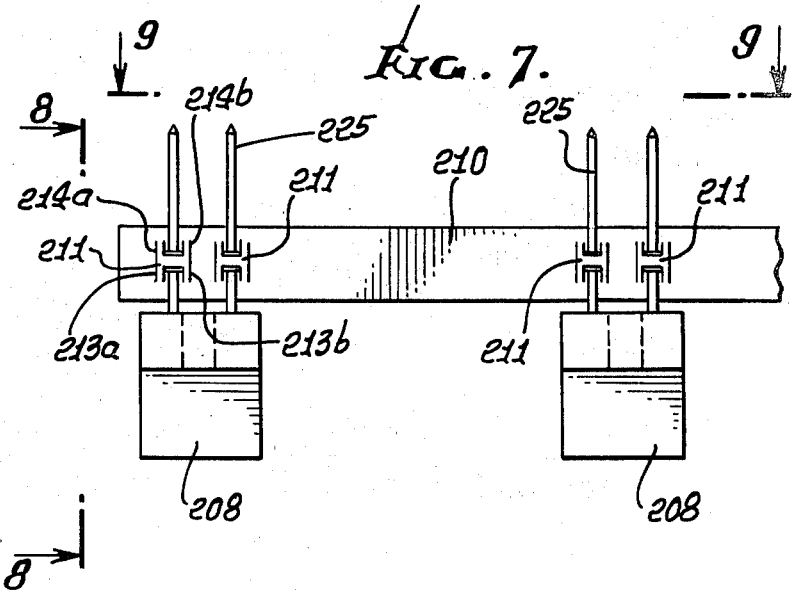
FIG. 7 is a frontal elevation showing an application of the invention.

Further, and more specifically, the contact 11 is preferably convex toward the plane of the strip, with convex survace 11*a* engaging surface 25*a* of the post 25 as seen in FIG. 3, along a line 11*b* which extends laterally of the contact and which lies closest to the plane of the strip. The contact is seen to have shallow U-shape. Accordingly, the contact resiliently and yieldably urges the post 25 toward the strip, so that the post flat side 25*b* flatly and firmly engages the strip. The latter may have a narrow conductive (as for example gold) band 24 extending therealong to be engaged by the post, at the locations of the tongues 20 and 21, as seen in FIG. 1. See engagement locations 20*a* and 21*a*. That band may be preliminarily applied to the strip and to have width "$w_1$" narrower than the width "w" of the strip, whereby conductive precious metal may be conserved.

Further and as seen in FIG. 3, the arm second ends 16, and the contact 11, in the region of their juncture, have inner surfaces 26 which are concave in a direction facing toward the plane of strip 10; and they also have outer surfaces 27 which are convex in a direction facing away from that plane. Accordingly, the resiliently yieldable mounting of the contact is enhanced. In addition, each pair of arms defines a gap therebetween which is wider than the width of the post, in received position. See in this regard gap width "g" in FIG. 1, which is wider than post width "p", in that view. Accordingly, ease of reception of the post, and without binding, is assured.

FIGS. 7–13 show multiple contacts, as defined above, spaced apart on bus strips, and multiple dual pairs of contact supporting arms, as described, the contacts and arms stamped out from the bus strip material. In FIGS. 7 to 10, the contacts 211 are shown as located in pairs, along the strip 210. Arms appear at 213*a*, 213*b*, 214*a* and 214*b*. Posts appear at 225, in pairs, and they project from circuit boards 208. In FIGS. 11–13, the construction is the same as in FIGS. 7–10, excepting that the bus strip 210 is deviated at 210*a*, so that the strip extensions 210*b* extend between and spaced from other posts 225*a* (see spaces 220 in FIG. 13), out of alignment with posts 225 engaging the contacts.

Contacts engaged by the received posts are resiliently displaced away from the plane of the bus-strip.

We claim:

1. In an electrical bus strip to receive a terminal post, the combination comprising (a) a horizontally elongated metallic bus strip;

(b) a contact integral with and spaced from said strip, said contact protruding toward a plane defined by said strip, and (c) two pairs of arms having first ends integral with said strip and second ends integral with said contact to support the contact for resiliently yieldable movement normal to said planes in response to insertion of a terminal post into position between the arms of each pair and between the contact and two tongues defined by said strip, (d) the bus strip defining an H-shaped opening adjacent said tongues and generally in registration with said contact and arms which were stamped from said strip.

2. The combination of claim 1 wherein the bus strip defines an H-shaped opening generally in registration with said contact and arms which were stamped from said strip.

3. The combination of claim 1 wherein the contact is convex toward said plane.

4. The combination of claim 3 wherein the contact has shallow U-shaped configuration.

5. The combination of claim 4 wherein the arm second ends and the contact in the regions of their juncture have inner surfaces which are concave in a direction facing toward said plane.

6. The combination of claim 5 wherein the arm second ends and the contact in the regions of their juncture have outer surfaces which are convex in a direction facing away from said plane.

7. The combination of claim 1 including said post received in said position, the contact engaging the post and displaced thereby relatively away from said plane.

8. The combination of claim 7 wherein each pair of arms defines a gap therebetween which is wider than the width of the post, in said position.

9. The combination of claim 1 including multiple contacts as defined in (b) of claim 1 spaced apart on the bus strip, and multiple dual pairs of arms as defined in (c) of claim 1, associated with the respective contacts.

10. The srip of claim 9 including an electrically conductive band on said strip intersecting said arms and contacts.

11. The combination of claim 9 wherein the contacts are spaced lengthwise of the bus strip.

12. The combination of either of claims 9 and 11 including multiple posts engaging the respective contacts, each post occupying the post position as defined as claim 1.

13. The combination of claim 11 wherein the strip includes a deviated portion whereby an extension of the strip extends between other posts which are out of alignment with posts engaging said contacts.

14. In an electrical bus strip to receive a terminal post, the combination comprising (a) a horizontally elongated metallic bus strip;

(b) a contact integral with and spaced from said strip, said contact protruding toward a plane defined by said strip, and (c) two pairs of arms having first ends integral with said strip and second ends integral with said contact to support the contact for resiliently yieldable movement normal to said planes in response to insertion of a terminal post into position between the arms of each pair and between the contact and an opening defined by said strip, (d) the contact located generally between said pairs of arms including said second ends thereof, the arms of each pair defining a gap therebetween, said opening generally in registration with said contact and arms.

* * * * *